United States Patent [19]

Redman

[11] Patent Number: 4,937,916

[45] Date of Patent: Jul. 3, 1990

[54] OFFSET DOOR PIVOT

[75] Inventor: Ronald E. Redman, Tucker, Ga.

[73] Assignee: Kawneer Company, Inc., Norcross, Ga.

[21] Appl. No.: 281,102

[22] Filed: Dec. 7, 1988

[51] Int. Cl.[5] ..... E05D 5/00; E05D 7/04

[52] U.S. Cl. ..... 16/243; 16/245; 16/248; 16/249; 16/261; 16/265; 16/273; 16/382; 16/384; 16/386; 16/388; 16/389; 16/DIG. 40; 49/382

[58] Field of Search ..... 16/243, 245, 248, 249, 16/254, 260, 261, 264, 265, 267, 273, 382, 384, 387, 388, 389, 386, DIG. 40; 49/382

[56] References Cited

U.S. PATENT DOCUMENTS

| | | | |
|---|---|---|---|
| 4,021,882 | 5/1977 | Polanco . | |
| 4,131,969 | 1/1979 | Suska | 16/388 |
| 4,184,382 | 1/1980 | Redman . | |
| 4,424,607 | 1/1984 | Langenhorst . | |
| 4,785,498 | 11/1988 | Brotschi | 16/382 |
| 4,827,568 | 5/1989 | Ramsayer | 16/266 |

FOREIGN PATENT DOCUMENTS

| | | | |
|---|---|---|---|
| 1800302 | 9/1977 | Fed. Rep. of Germany | 16/264 |
| 2217932 | 9/1980 | Fed. Rep. of Germany | 16/265 |
| 3525279 | 1/1987 | Fed. Rep. of Germany | 16/254 |
| 542106 | 8/1922 | France | 16/261 |
| 2576959 | 8/1986 | France | 16/264 |
| 566337 | 8/1957 | Italy | 16/386 |
| 2196383 | 4/1988 | United Kingdom | 16/264 |

OTHER PUBLICATIONS

Kawneer Architectural Detail manual, *Hardware/Aluminum Entrances*, pp. A9-1 and A9-2 (1980).

*Primary Examiner*—Richard K. Seidel
*Assistant Examiner*—Edward A. Brown
*Attorney, Agent, or Firm*—Jones, Askew & Lunsford

[57] ABSTRACT

An improved offset door pivot is disclosed wherein the pivot is mountable to the face of a door without having to mortise or otherwise machine the door. Further, the door pivot is non-handed, such that the identical pivot can be mounted to either the right-or left-hand side of the door.

12 Claims, 4 Drawing Sheets

OFFSET DOOR PIVOT

TECHNICAL FIELD

The present invention relates generally to hardware for pivotably mounting a door to a door frame, and relates more specifically to an improved offset door pivot wherein the pivot is mountable to the face of the door without having to mortise or otherwise machine the door, and wherein the door pivot is non-handed such that the identical pivot can be mounted to either the right- or left-hand side of the door.

BACKGROUND OF THE INVENTION

Pivots for movably mounting a door to a door frame are well known. Door pivots typically comprise a bracket anchored to the doorjamb which pivotably cooperates with a second portion mounted to the face of the door. A door pivot differs from a hinge primarily in that the axis of rotation of a hinge is coincident to or outside the lateral edge of the door, whereas the axis of rotation of a pivot falls inside the lateral edge of the door. For oversized doors or doors in commercial installations which are subjected to a high volume of traffic, pivots provide certain mechanical advantages over hinges which make them desirable.

At least two door pivots, mounted one each at the top and bottom of the door, are required to mount the door to the frame. In high-traffic application or on large doors, one or more intermediate pivots may also be used, mounted at locations vertically intermediate the top and bottom pivots.

Door pivots are broadly categorized according to their intended mounting position on the door. All doors require at least two pivots, a top pivot and a bottom pivot. The bottom pivot is the privary load bearing pivot and typically includes a ball bearing located in the door portion of the pivot for enhanced load carrying capability. In contrast, top pivots do not bear as great a portion of the weight of the door as bottom pivots. Instead, top pivots are designed primarly to provide an upper pivot point for the door and to withstand lateral forces exerted against the door resulting from the torque applied to open the door. The lateral loads exerted against a top pivot exert a shear force against the screws holding the frame portion of the pivot to the header, rather than a tension force against the screws holding the door portion to the stile. Since screws under shear have a greater load bearing capability than screws under tension, the top pivot effectively withstands lateral loads but is not effective in resisting heavy vertical loads.

On oversized doors or doors in commercial installations which are subjected to high traffic volumes, a third type of pivot is often used, the intermediate pivot. Intermediate pivots, so called because they are mounted at locations vertically intermediate the top and bottom pivots, differ from top pivots primarily in that they are intended to bear more of a vertical load than top pivots. Intermediate pivots differ from bottom pivots primarily in that they must resist greater lateral forces than bottom pivots. Intermediate pivots thus present unique design challenges, since they must bear vertical loads like a bottom pivot while resisting lateral loads like a top pivot.

Door pivots may be further categorized as either center pivots or offset pivots, depending upon where the axis of rotation of the pivot lies in a vertical plane with respect to the door. With a center pivot, the axis of rotation falls in a vertical plane intermediate the inner and outer stiles of the door. Center pivots are primarily used when it is desired to mount a door which can pivot in both directions. However, in order to position the axis of rotation intermediate the stiles of the door, channels or recesses must be cut into the stiles to mount the pivot. While center pivots are acceptable for mounting interior or vestibule doors, the interruptions in the door required to mount a center pivot make the center pivot undesirable for exterior applications which require weather sealing, since the channels which are cut into the lateral edge of the door to mount the door pivot will permit air and water to pass through.

For such exterior applications which require weather sealing, the offset door pivot is the more desirable alternative. The bracket of the pivot assembly typically comprises a first leg portion which is mortised into and anchored to the jamb of the door frame. A second leg portion extends past the face of the door and includes a pivot interface for cooperating with a door portion of the pivot assembly. The door portion is typically mortised into the face of the door such that the edge of the door portion bears against the edge of the mortise to support the vertical load of the door. The pivot interface between the door portion and the bracket will typically include a spindle formed on one of the bracket or door portions, with a cooperating bore on the other member which receives the spindle for rotational movement therein.

One of the difficulties presented by a conventional offset door pivot is the requirement that the face of the door be mortised or otherwise machined to provide a horizontal surface against which the door portion can bear to support the vertical load exerted by the weight of the door. Mortising the door requires time, special machinery, and skilled labor, which increases the cost of installing the door pivot. Thus, there is a need to provide a door pivot wherein the door portion is capable of supporting a vertical load without the requirement that the face of the door be mortised.

Another problem associated with conventional intermediate offset pivots is that a given pivot assembly will be either left-handed or right-handed, depending upon the direction of the angle formed by the first and second legs of the bracket member. Such handed pivots double the inventory of pivots which a building supplier must keep on hand. Further, the possibility of error is introduced, in that a worker may arrive at the work site with, for example, a left-handed pivot to hang a right-handed door, thereby causing aggravation, delay, and increased cost of installation. Finally, there is the possibility that a worker may attempt, either accidentally or unknowingly, to install a wrong-handed pivot for a particular application. Thus, there is a need to provide a non-handed intermediate offset door pivot.

SUMMARY OF THE INVENTION

As will be seen, the present invention overcomes these and other problems associated with prior art offset door pivots. Stated generally, the present invention comprises an improved offset door pivot for mounting a hollow core door to a door frame wherein the pivot can be mounted to the door without the need for mortising the face of the door. The pivot is non-handed such that a given pivot may be mounted to either a right- or left-handed door, as the application may dictate. Thus, inventory demands are reduced, and the possibility of arriving at a job site with a wrong-handed pivot or accidentally attempting to install a wrong-handed pivot is eliminated.

Stated somewhat more specifically, the door pivot of the present invention comprises a bracket for mounting to the door frame to pivotably interact with a housing mounted to the face of the door. The housing has a boss projecting from the rear face thereof, which boss is received within a bore which can be quickly and easily drilled in the face of the door. With the housing mounted to the face of the door, the boss bears against the wall of the bore to support the weight of the door. A spindle formed on the bottom of the housing pivotably cooperates with a bore formed in the bracket to mount the door to the frame. The bracket is symmetrical about a horizontal plane such that the bracket may be used for either right- or left-handed applications by simply rotating the bracket about a horizontal axis.

Stated more precisely, the housing of the disclosed door pivot is especially adapted for mounting to a hollow core door. The boss projecting from the back face of the housing has a transverse lug formed thereon in spaced-apart relation to the housing. When the housing is positioned against the face of the door, the boss is received through the bore, and the lug projects from a portion of the bore which projects through the inner face of the door stile.

The housing is secured to the face of the door by a pair of screws having frustoconical heads. The shafts of the screws are received through a pair of elongated slots formed on the body of the housing. Each elongated slot has a frustoconical countersink formed eccentrically thereto, such that as the frustoconical head of the screw engages the countersink, the housing is displaced upwardly. In this manner, tightening the mounting screws urges the upper edge of the boss against the upper wall of the bore, with the lug engaging the interior face of the door stile to prevent the boss from being extracted from the bore.

The bracket comprises a first leg which is mounted to the doorjamb and a second leg which is offset with respect to the first leg and has a vertical bore formed therethrough. The bore in the bracket is adapted to receive the spindle on the bottom of the housing for rotational movement therein. The bracket is suitable for use on either the right- or left-hand side of the door by simply rotating the bracket about a horizontal axis until the offset leg extends in the desired direction. Since the vertical bore extends completely through the bracket, the spindle on the bottom of the housing can be received into either end of the bore. In this manner, the door pivot is easily adapted to either right-handed or left-handed applications.

Thus, it is an object of the present invention to provide an improved offset door pivot.

It is a further object of the present invention to provide a non-handed offset door pivot wherein the pivot is suitable for use on either right- or left-handed doors.

It is another object of the present invention to provide an offset door pivot which can be mounted to the face of a door without the need for machining the face of the door.

It is yet another object of the present invention to provide an improved offset door pivot which can be quickly and easily installed without the need for special tools or skilled labor.

Other objects, features, and advantages of the present invention will become apparent upon reading the following specification when taken in conjunction with the drawings and the appended claims.

DETAILED DESCRIPTION OF THE DISCLOSED EMBODIMENT

Figure 1:
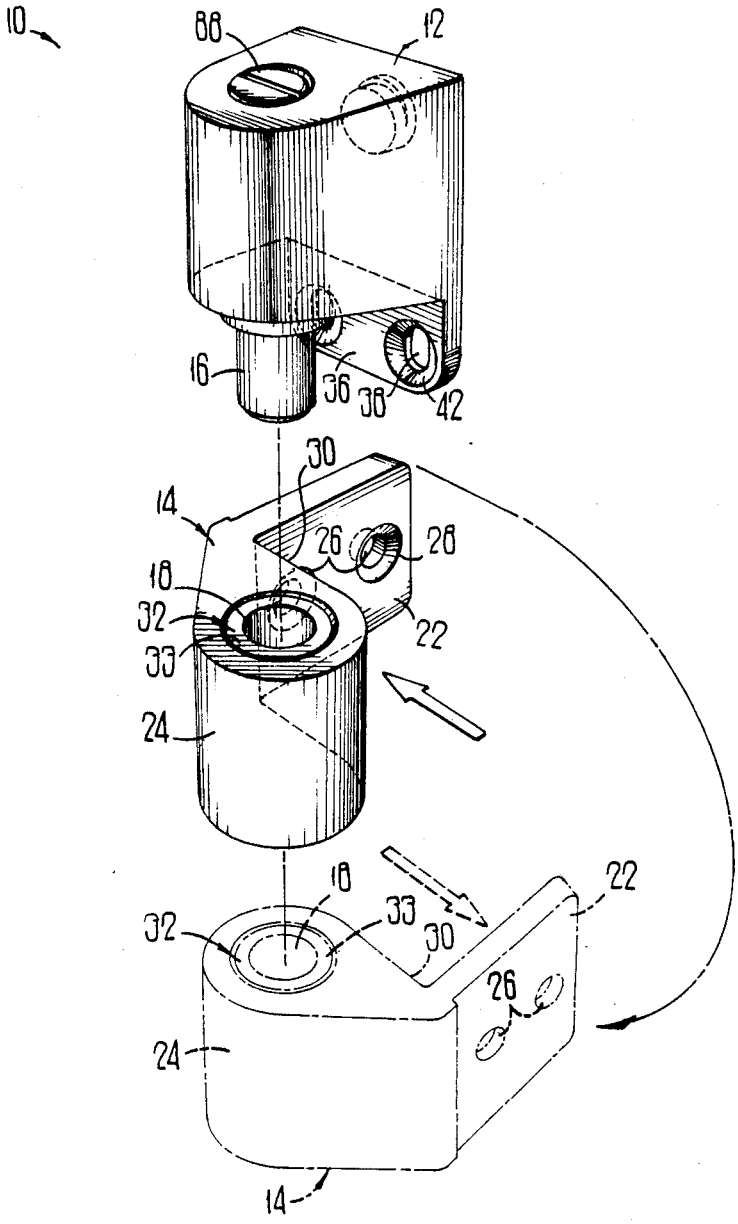
FIG. 1 is an exploded perspective view of an improved offset door pivot according to the present invention.

Referring now in more detail to the drawings, in which like numerals indicate like elements throughout the several views, FIG. 1 shows an intermediate offset door pivot 10 according to the present invention. The pivot 10 includes a housing 12 for mounting to the pivot stile of a door and a bracket 14 for mounting to a door jamb. The housing 12 includes a vertical spindle 16 projecting downwardly from the housing. The spindle is adapted to be received for rotation within a vertical bore 18 formed in the bracket 14.

The bracket 14 comprises a first leg portion 22 and a second leg portion 24 which is offset with respect to the first leg portion. The first leg portion 22 has a pair of bores 26 formed therein for receiving mounting screws therethrough to mount the bracket 14 to a door jamb. Each bore 26 has a frustoconical countersink 28 formed concentrically thereto.

The second leg portion 24 of the bracket 14 has an inner face 30. The inner face 30 of the second leg portion intersects the first leg portion 22 at a right angle. While the first leg portion 22 of the bracket 14 is essentially planar, the second leg portion 24 is shaped like a teardrop, with the narrow end intersecting the first leg portion 22 and the enlarged end defining the bore 18. The bore 18 has a pair of concentric sleeves 32 disposed therein, each of which has an outer end 33. While the housing 12 and bracket 14 are advantageously formed of cast aluminum, the spindle 16 and the sleeve 32 of the bore 26 are formed of hardened steel, brass, or the like, for improved resistance to wear.

The bracket 14 of the disclosed embodiment is symmetrical about a horizontal plane passing through its vertical midpoint. The bracket 14 shown in solid lines in FIG. 1 has its second leg portion 24 offset to the right of the first leg portion 22 in an orientation appropriate for mounting the bracket to the left jamb of a door. However, by rotating the bracket 14 about a horizontal axis, the inverted housing 14 shown in phantom lines in FIG. 1 has its second leg portion 24 offset to the left of the first leg portion 22 in an orientation appropriate for mounting to the right jamb of a door.

Figure 2:
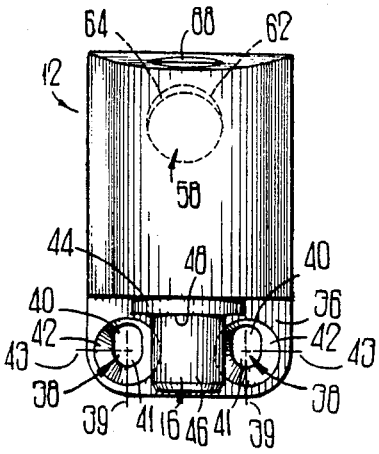
FIG. 2 is a front elevation view of the housing of the door pivot of FIG. 1.

Referring now to FIG. 2, the housing 12 includes a bracket portion 36 formed at its lower end. The bracket portion 36 is essentially planar and has a pair of elongated slots 38 formed therein. Each slot 38 has an elogate axis 39 and has an upper end 40 and a lower end 41. A frustoconical countersink 42 is associated with each elongated slot 38. The horizontal centers of the countersinks 42 lie along the elognate axes 39 of the slots 38. However, the vertical centers of the countersinks 42, indicated by the horizontal center line 43, lie below the vertical centers of the slots 38 and proximate the lower ends 41 of the slots. The frustoconical countersinks 42 are thus eccentric to the elongated slots 38. Each elongated slot 38 has a major portion disposed above the horizontal center line 43 of the countersink 42 and has a minot portion disposed below the center line 43. The cooperative relationship between the elongated slots 38 and the eccentric countersinks 42 will be discussed more thoroughly below with respect to mounting the housing 12 to a door.

The spindle 16 protruding downwardly from the housing 12 comprises an enlarged upper cylindrical portion 44 and a reduced lower cylindrical portion 46 concentric with the upper portion 44. The surface on the bottom of the enlarged upper portion 44 and around the reduced lower portion 46 comprises an annular bearing surface 48.

Figure 5:
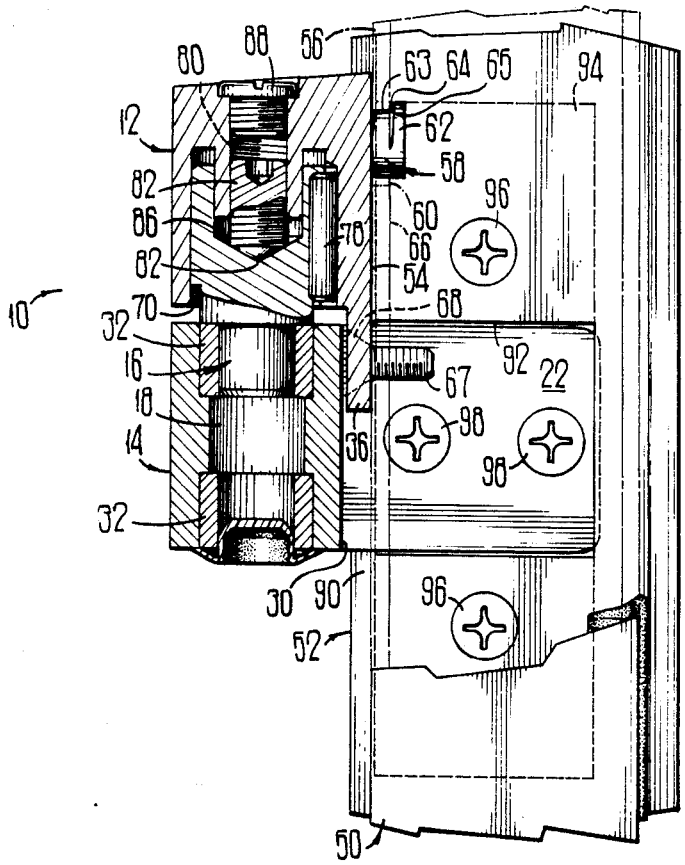
FIG. 5 is a side cut away view of the installed door pivot taken along line 5—5 of FIG. 4.
Figure 3:
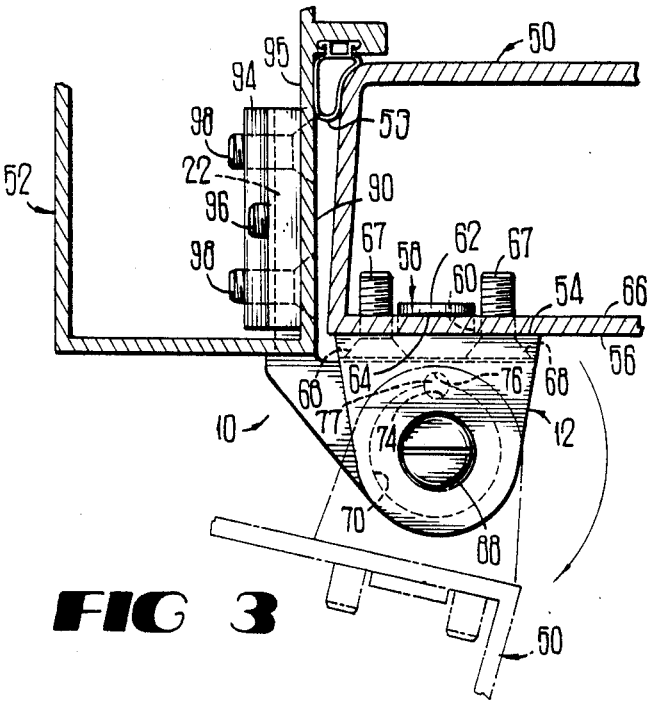
FIG. 3 is a top plan view of a hollow cored door piotably mounted to a door frame using the pivot of FIG. 1.
Figure 4:
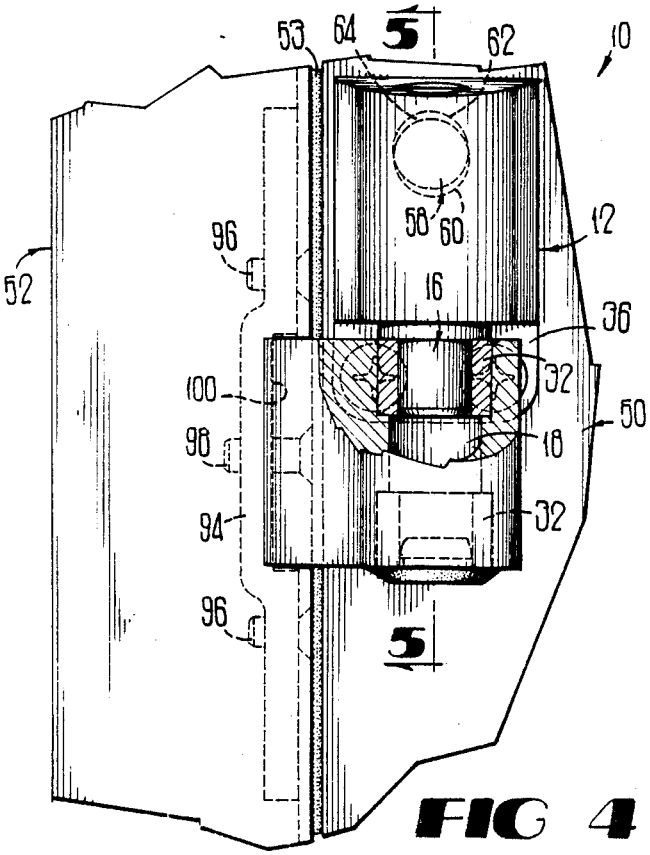
FIG. 4 is a front elevation view of the installed door pivot of FIG. 1, with the bracket shown partially cut away to reveal interior detail.

FIGS. 3–5 depict the pivot 10 installed to pivotably mount a hollow core door 50 to a door frame 52. The door 50 and door frame 52 depicted in FIGS. 3–5 are for an exterior installation and include a gasket or weather seal 53 sealing the juncture between the door and frame. The pivot 10 is intended for use as an intermediate pivot, and it will be understood that the pivot 10 can be used with top and bottom offset pivots of conventional design. The rear face 54 of the housing 12 is imposed against the pivot stile 56 of the hollow core door 50. A boss 58 projecting rearwardly from the rear face 54 of the housing 12 is received through a bore 60 in the pivot stile 56 of the door 50. The boss 58 has a lug 62 (FIG. 5) projecting upwardly therefrom at a point on the lug which is spaced apart from the rear face 54 of the housing 12. The upper surface of that portion of the boss 58 lying between the lug 62 and the rear face 54 of the housing defines a shoulder 63 which is imposed against the upper wall of the bore 60. The interior edge 64 of the lug 62 adjacent the shoulder 63 is beveled toward the rear face 54 of the housing 12. The beveled interior edge 64 of the lug 62 bears against the intersection 65 of the upper wall of the bore 60 and the interior surface 66 of the pivot stile 56. The housing 12 is anchored to the pivot stile 56 of the door 50 by a pair of mounting screws 67 inserted through the elongated slots 38 in the bracket portion 36 of the housing and threaded into the stile. The mounting screws 67 have frustoconical heads 68 which engage the frustoconical countersinks 42 in the housing 12.

Interior detail of the housing 12 is shown in FIG. 5. The housing 12 has a cylindrical recess 70 formed in its lower end into which the upper end of the spindle 16 is received. As can perhaps best be seen in FIG. 3, a vertically elongated semicylindrical recess 74 formed on the vertical exterior face of the spindle 16 is aligned with a corresponding vertical semicylindrical recess 76 in the wall of the spindle recess 70 to form a cylindrical keyway 77. An elongated cylindrical retaining or antirotational pin 78 is inserted into the keyway 77 to prevent the spindle 16 from rotating within the spindle recess 70.

As further shown in FIG. 5, a threaded bore 80 is formed in the upper portion of the housing 12 coaxially and in communication with the spindle recess 70. A hex-head set screw 82 is threaded into the bore 80, and the point 84 of the set screw projects from the bottom of the bore and engages a depression 86 formed in the upper portion of the spindle 16. Vertical adjustment of the spindle 16 with respect to the housing 12 can be accomplished by tightening or loosening the set screw 82. A cover screw 88 is then threaded into the upper portion of the threaded bore 80 to restrict tampering with the set screw 82 and to present an aesthetically pleasing appearance.

As shown in FIGS. 3–5, the bracket 14 is mortised into the jamb 90 of the frame 52. The mortise comprises a channel 92 cut through the jamb 90 with a plate 94 mounted to the backside 95 of the jamb by a pair of mounting screws 96. The first leg portion 22 of the bracket 14 is received into the channel 92 and secured to the plate 94 by a second pair of mounting screws 98. As can best be seen in FIG. 4, the plate 94 of the disclosed embodiment has a channel 100 formed therein corresponding with the channel 92 cut into the jamb 90. The combined depths of the channel 92 in the jamb 90 and the channel 100 in the plate 94 are equal to the thickness of the first leg portion 22 of the bracket 14 so that the outer face 102 of the leg portion 22 is flush with the face of the jamb 90.

The procedure for mounting the pivot 10 to the door 50 and frame 52 will now be explained. The first step in mounting the housing 12 to the pivot stile 56 of the door 50 is to drill the bore 60 at the desired mounting location. Then drill and tap the two holes for the mounting screws. The boss 58 projecting from the rear of the housing 12 is then inserted into the bore 60 until the rear face 54 of the housing is imposed against the pivot stile 56 of the door 50. The mounting screws 67 are then inserted through the upper ends 40 of the elongated slots 38 and threaded into the pivot stile 56. As the mounting screws 67 are threaded into the stile 56, the frustoconical heads 68 of the screws bear against the upper portion of the countersinks 42, and the screw heads will tend to center themselves within the countersinks. The force brought to bear by the frustoconical screw heads 68 against the countersinks 42 will cause the housing 12 to translate along the direction of the elongate axis 39 of the slots 38. As the mounting screws 67 center themselves within the countersinks 42 and the housing 12 translates upwardly, the elongated slots 58 will move upwardly relative to the fixed mounting screws until the screws ride in the lower ends 41 of the slots. The upward translation of the housing 12 will urge the shoulder 63 of the boss 58 against the upper wall of the bore 60. As the shoulder 63 is urged against the upper bore wall, the lug 62 will project beyond the upper edge of the bore 60, thereby preventing the boss 58 from being extracted from the bore 60. The beveled inner edge 64 of the lug 62 will bear against the intersection 65 of the upper wall of the bore 60 and the inner face 66 of the pivot stile 56 to draw the rear face 54 of the housing 12 firmly against the pivot stile 56.

To mount the bracket 14 to the door frame 52, the channel 92 is cut through the jamb 90 at the desired height. The plate 94 is positioned against the backside 95 of the jamb 90 with the channel 100 in the plate corresponding to the channel 92 cut in the jamb. The plate 94 is secured in place with the pair of screws 96.

The first leg portion 22 of the bracket 14 is then inserted into the recess formed by the channel 92 in the jamb 90 and the channel 100 in the plate 94, with the bracket oriented such that the second leg portion 24 is offset in the direction of the door 50. The bracket 14 is secured in place by inserting the mounting screws 98 through the bores 26 in the first leg portion 22 of the bracket and threading them into the plate 94.

With the housing 12 thus mounted to the pivot stile 56 of the door 50 and the bracket 14 mounted to the door frame 52, the door is mounted to the frame by inserting the reduced lower portion 46 of the spindle 16 into the bore 18 in the second leg portion 24 of the bracket. The annular bearing surface 48 of the spindle will bear against the upper surface 33 of the upper sleeve 32 to support the weight of the door. If vertical adjustment of the door is necessary to align it properly with the frame 52, the cover screw 88 is removed from the upper end of the housing 12 to permit access to the set screw 82. To raise the door, the set screw 82 is tightened, causing the tip 84 of the set screw to bear against the depression 86 in the upper end of the spindle 16. To lower the door, the set screw 82 is retracted, permitting the weight of the door to force the spindle 16 upwardly within the spindle recess 70.

Figure 6:
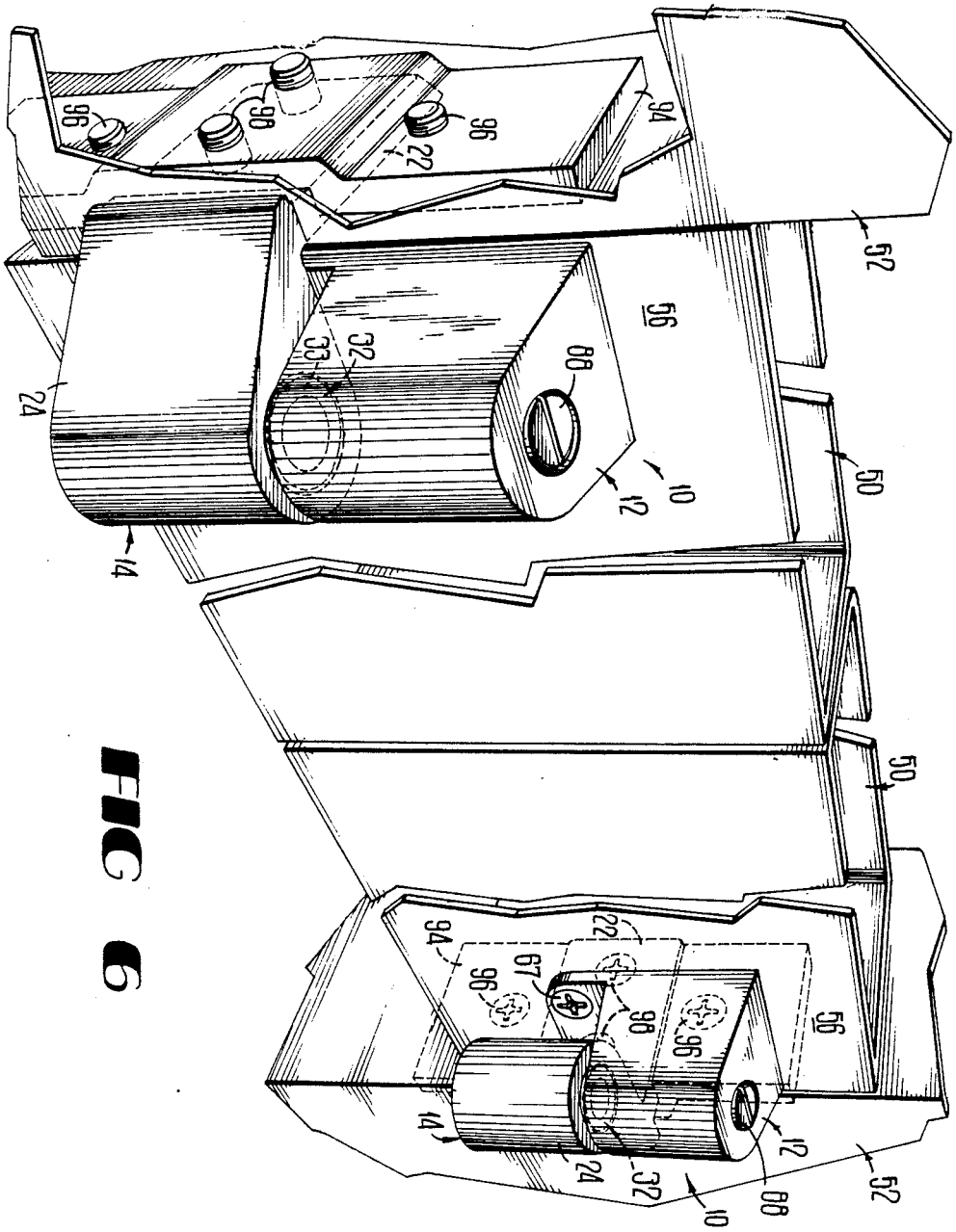
FIG. 6 is a perspective view showning the door pivot of FIG. 1 installed for both right- and left-handed applications.

An important feature of the present invention concerns the non-handed aspect of the pivot 10. As can be seen in FIGS. 1 and 6, the same pivot 10 can be used on either the right- or left-hand side of a door by simply rotating the bracket 14 about its horizontal axis until the offset of the second leg portion 24 projects in the desired direction. Since the bore 18 extends completely through the spindle 16 so as to be open at both ends, the bore can receive the spindle 16 for rotational movement therein irrespective of which end the bracket is facing upwardly. Since the same pivot 10 can be used on either the right- or left-hand side of a door, there is no need to maintain an inventory of both left-handed and right-handed door pivots. Further, the possibility of a workman arriving at a job site with a left-hand pivot for a right-handed door is eliminated, as is the possibility of a worker accidentally or unknowingly attempting to installed a handed pivot on the wrong side of the door.

Another important feature of the present invention concerns the manner in which the housing 12 is mounted to the stile 56 of the door 50. Mounting the housing 12 to the door 50 requires only drilling three holes, rather than mortising the face of the door. Such holes bore can be formed with a conventional drill by relatively unskilled labor, rather than requiring a mortise, which is considerably more difficult to accomplish and requires more complicated tools and skilled labor. Further, the provision of the elongated slots 38 with the eccentric countersink eliminates some of the need for precision in mounting the housing, since the mere act of tightening the mounting screws 67 will align the housing. Further, the provision of a beveled inside edge 64 on the lug 62 affords the additional advantage that the process of tightening the mounting screws 67 will simultaneously draw the rear face 54 of the housing 12 snugly against the door stile 56.

While the preferred embodiment has been disclosed with respect to a spindle mounted on the housing to cooperatively interact with a bore formed on the bracket, it will be appreciated that a similar cooperative rotational interaction can be provided by forming a spinsle on the bracket to engage a bore formed in the housing. However, such an arrangement would present a slight disadvantage in that in order to make the bracket non-handed, it will be necessary to provide two spindles, one projecting upwardly from the bracket and the other projecting downwardly, so that when the bracket is rotated about its horizontal axis for opposite-handed installation, a spindle will be in the desired orientation. Thus, regardless of the orientation in which the bracket is installed, an unused spindle will always be projecting from the lower end of the bracket, affording a less aesthetically pleasing appearance than the arrangement of the preferred embodiment, wherein the spindle is mounted to the housing and the bore is formed in the bracket.

Finally, it will be understood that the preferred embodiment of the present invention has been disclosed by way of example, and that other modifications may occur to those skilled in the art without departing from the scope and spirit of the appended claims.

What is claimed is:

1. An apparatus for attaching a workpiece to a planar member having opposite first and second faces and walls defining a bore in said planar member transverse to said opposing first and second faces, said apparatus comprising:

a boss protruding from said workpiece;

means defining a hole through said workpiece in spaced-apart relation to and generally parallel to said boss, said hole being generally oblong in cross-section and having an elongate axis;

a lug projecting from said boss at a point thereon spaced apart from said workpiece by a distance approximately equal to the distance between said first and second faces of said planar member, said boss and said lug being dimensioned to be received through said bore in said planar member;

a fastener for inserting through said oblong hole in said workpiece and into said planar member, said fastener having a wedging surface formed thereon; and a bearing surface on said workpiece aligned with said oblong hole such that when said fastener is inserted through said hole, said wedging surface on said fastener bears against said bearing surface on said workpiece to exert a force against said workpiece in a direction generally coincident with said elongate axis of said hole;

whereby when said boss is inserted through said first face of said planar member and into said bore in said planar member, and said fastener is inserted through said hole in said workpiece and into said first face of said planar member, said fastener draws said workpiece against said first face of said planar member, said wedging surface on said fastener impinging against said bearing surface on said workpiece to translate said workpiece in said direction generally coincident with said elongate axis of said hole, said boss thereby being urged laterally against said walls of said bore, and said lug thereby being imposed against said second face of said planar member to prevent said boss from being extracted from said bore, whereby said workpiece is anchored to said first face of said planar member.

2. The apparatus of claim 1, wherein said lug further comprises a wedging surface formed hereon such that when said boss is urged laterally against said bore wall, said lug wedging surface bears against the juncture between said bore wall and said second face of said planar member to draw said workpiece snugly against said first face of said planar member.

3. The apparatus of claim 1, wherein said fastener comprises a head portion and a threaded shank, and wherein said wedging surface formed on said fastener comprises a frustoconical wedging surface formed adjacent to said head portion in coaxial alignment with said threaded shank.

4. An apparatus comprising:

a hollow-core door having a door panel defining one vertical surface thereof, said door panel comprising opposing outer and inner faces in parallel, spaced-apart relation, and said panel defining a bore therethrough transverse to said opposing outer and inner faces;

a housing imposed against said outer face of said door panel;

a boss projecting from said housing and being received through said bore in said door panel to protrude through said inner face of said door panel such that a portion of said boss projects beyond said inner face;

a lug projecting from said boss at a point on said boss which projects beyond said inner face of said door panel;

means defining a hole through said housing in spaced-apart relation to and generally parallel to said boss, said hole being generally oblong in cross-section, said oblong hole havingg an elongate axis transverse to the direction of said hole;

a fastener inserted through said oblong hole in said housing and into said door panel, said fastener having a wedging surface formed thereon;

a bearing surface on said housing aligned with said oblong hole such that when said fastener is inserted through said hole, said wedging surface on said fastener bears against said bearing surface on said housing to translate said housing in a direction generally coincident with said elongate axis of said oblong hole, said translation imposing said boss against the walls of said bore with said lug being imposed against said inner face of said door panel to prevent said boss from being extracted from said bore;

a door frame dimensioned to received said door therewithin;

a generally L-shaped frame member having first and second legs, said first leg of said L-shaped frame member being mounted to said door frame;

a spindle formed on one of said housing and said second leg of said L-shaped frame member; and means defining a bore in the other of said housing and said second leg of said L-shaped frame member and receiving said spindle for rotational movement therein, whereby said door is pivotably mounted to said door frame.

5. The apparatus of claim 4, wherein said spindle projects from said housing, and wherein said means defining said bore comprises said second leg of said frame member having a bore formed in its upper end and receiving said spindle for rotational movement therein.

6. The apparatus of claim 4, wherein said lug further comprises a wedging surface formed thereon such that when said boss is imposed against said bore wall, said lug wedging surface bears against the juncture between said bore wall and said inner face of said door panel to draw said housing snugly against said outer face of said door panel.

7. The apparatus of claim 4, wherein said fastener comprises a head portion and a threaded shank, and wherein said wedging surface formed on said fastener comprises a frustoconical wedging surface formed adjacent to said head portion in coaxial alignment with said threaded shank.

8. The apparatus of claim 5, wherein said bore formed in said upper end of said generally L-shaped frame member extends through said L-shaped frame member such that said spindle is receivable into either end of said bore; and wherein said L-shaped frame member is generally symmetrical about a horizontal plane, whereby said L-shaped frame member can be mounted to said door frame on either the right or left side of said door by rotating said frame member about a horizontal axis of rotation.

9. A mounting apparatus for pivotably mounting a hollow-core door to a door frame, said hollow-core door having a door panel defining one vertical surface thereof, said door panel comprising opposing outer and inner faces in parallel, spaced-apart relation, and said door panel further comprising means defining a bore through said panel transverse to said opposing outer and inner faces, said mounting apparatus comprising:

a housing for imposing against said outer face of said door panel;

a boss projecting from said housing such that when said housing is imposed against said outer face of said door panel, said boss is received through said bore in said door panel to protrude through said inner face of said door panel such that a portion of said boss projects beyond said inner face;

a lug projecting from said boss at a point on said boss which projects beyond said inner face of said door panel when said housing is imposed against said outer face of said door panel;

said housing defining a hole therethrough in spaced-apart relation to and generally parallel to said boss, said hole being generally oblong in cross-section, said oblong hole having an longate axis in the plane transverse to the direction of said hole;

a fastener for inserting through said oblong hole in said housing and into said door panel when said housing is imposed against said outer face of said door panel, said fatener having a wedging surface formed thereon;

a bearing surface on said housing aligned with said oblong hole such that when said fastener is inserted through said hole, said wedging surface on said fastener bears against said bearing surface on said housing to translate said housing in a direction generally coincident with said elongate axis of said oblong hole, said translation imposing said boss against the walls of said bore with said lug being imposed against said inner face of said door panel to prevent said boss from being extracted from said bore;

a spindle projecting from said housing; and a generally L-shaped frame member, one leg of said L-shaped frame member being mountable to said door frame, and the other leg of said frame member having a bore formed in its upper end for receiving said spindle for rotational movement therein, whereby when said housing is imposed against said outer face of said door panel and said fastener is inserted through said hole in said housing to anchor said housing to said outer face of said door panel, and when said L-shaped frame member is mounted to said door frame, said spindle on said housing is received within said bore formed in sail L-shaped frame member to pivotably mount said door to said door frame.

10. The apparatus of claim 9, wherein said lug further comprises a wedging surface formed thereon such that when said boss is imposed against said bore wall, said lug wedging surface bears against the juncture between said bore wall and said inner face of said door panel to draw said housing snugly against said outer face of said door panel.

11. The apparatus of claim 9, wherein said fastener comprises a head portion and a threaded shank, and wherein said wedging surface formed on said fastener comprises a frustoconical wedging surface formed adjacent to said head portion in coaxial alignment with said threaded shank.

12. The apparatus of claim 9, wherein said bore formed in said upper end of said generally L-shaped frame member extends through said L-shaped frame member such that said spindle is receivable into either end of said bore; and wherein said L-shaped frame member is generally symmetrical about a horizontal plane, whereby said L-shaped frame member can be mounted to said door frame on either the right or left side of said door by rotating said frame member about a horizontal axis of rotation.

* * * * *